US005896767A

United States Patent [19]

Gomi

[11] Patent Number: 5,896,767

[45] Date of Patent: Apr. 27, 1999

[54] AUTOMOTIVE DOOR LATCH DEVICE

[75] Inventor: Yoshito Gomi, Yamanashi-ken, Japan

[73] Assignee: Mitsui Kinzoku Kogyo Kabushiki Kaisha, Tokyo, Japan

[21] Appl. No.: 09/079,296

[22] Filed: May 15, 1998

[30] Foreign Application Priority Data

May 15, 1997 [JP] Japan ..... 9-140965

[51] Int. Cl.[6] ..... E05B 65/12; E05C 3/16

[52] U.S. Cl. ..... 70/237; 292/216; 292/DIG. 23

[58] Field of Search ..... 70/237; 292/169.11, 292/169.14, 216, DIG. 23, DIG. 43, DIG. 65

[56] References Cited

U.S. PATENT DOCUMENTS

| | | | |
|---|---|---|---|
| 4,634,156 | 1/1987 | Shimura et al. | 292/216 |
| 5,046,769 | 9/1991 | Rimbey et al. | 292/216 |
| 5,054,827 | 10/1991 | Konchan et al. | 292/216 |
| 5,100,185 | 3/1992 | Menke et al. | 292/216 |
| 5,106,135 | 4/1992 | Menke et al. | 292/216 |
| 5,137,311 | 8/1992 | Horst | 292/DIG. 43 |
| 5,232,253 | 8/1993 | Tamiya | 292/DIG. 43 |
| 5,273,325 | 12/1993 | Zimmermann | 292/DIG. 43 |
| 5,277,461 | 1/1994 | Dzurko et al. | 292/216 |
| 5,718,465 | 2/1998 | Dowling et al. | 292/DIG. 65 |

FOREIGN PATENT DOCUMENTS 07-034742 2/1995 Japan .

*Primary Examiner*—Darnell Boucher
*Assistant Examiner*—Stephen Grady
*Attorney, Agent, or Firm*—Browdy and Neimark

[57] ABSTRACT

An automotive door latch device comprises a latch body having a horizontal passage into which a striker enters, a latch rotatably mounted to the latch body by a latch shaft, a ratchet rotatably mounted to the latch body by a ratchet shaft, a lock lever switched between an unlocked position and a locked position, a block lever rotatably mounted to the latch body by a block shaft and engaging with the lock lever when the latch is in an unlatched position to prevent the lock lever from moving from the unlocked position to the locked position. The latch and the ratchet is substantially arranged along a vertical direction. A straight line connecting the ratchet shaft and the block shaft is substantially in parallel to the horizontal passage of the latch body. The block lever is connected to the ratchet lever by a connection pin.

6 Claims, 9 Drawing Sheets

AUTOMOTIVE DOOR LATCH DEVICE

BACKGROUND OF THE INVENTION

1. Field of the Invention

The present invention relates to an automotive door latch device, and particularly relates to a latch device in which an automotive door cannot be locked when it is in a door-open position.

2. Description of the Related Arts

In a conventional automotive door latch device, a door can be simply and easily locked by switching the latch device of the door into a locked state by an locking operation of an inside locking button of the door even if the door is in an open position. Therefore, there frequently occurs a trouble of closing the door under the locked state while putting the door key within a vehicle cabin.

Further, in a conventional art, in order to reduce the trouble mentioned above, there is suggested an automotive door latch device which requires an additional entry operation such as an opening operation of a door open handle. This latch device comprises, as shown in FIG. 9, a latch B displaceable from an unlatched position to a full-latched position by engaging with a striker A, a ratchet C for holding an engagement between the latch B and the striker A by engaging with the latch B, an open lever D connected to an open handle of a door, an open link G having an engagement surface F which engages with a ratchet pin E of the ratchet C when the open lever D rotates so as to disengage the ratchet C from the latch B, and a lock lever H connected to a key cylinder and an inside lock button of the door and switched between an unlocked position for enabling an opening operation of the open link G and a locked position for disabling the opening operation of the open link G. The ratchet pin E is displaceable between a door-closed position shown by a solid line in which the the ratchet C is engaged with the latch B and an door-open position shown by a dot line in which the ratchet C is disengaged from the latch B. The open link G has a projection J which is engageable with the ratchet pin E at the door-open position but is disengageable with the ratchet pin E at the door-closed position.

In the full-latched or door-closed state shown in FIG. 9, since the projection J is disengageable with the ratchet pin E shown by the solid line, the lock lever H can be rotated clockwise by a locking operation of the inside lock button so as to move the open link G leftward, thereby the latch device can be switched to a locked state in which the engagement surface F is disengageable with the ratchet pin E.

On the contrary, in the unlatched or door-open state, the ratchet pin E is displaced to the door-open position shown by the dot line, and precludes the open link G from moving leftward by engaging with the projection J, thereby the lock lever H cannot be rotated clockwise and the latch device is held in the unlocked state. A facing between the pin E and the projection J can be cancelled by the opening operation of the open handle as an entry operation. The opening operation moves the open link G downward so as to make the projection J apart from the ratchet pin E shown by the dot line, thereby the lock lever H can be rotated clockwise even when the door is in the open position.

As mentioned above, the conventional latch device shown in FIG. 9 prevents the latch device from being erroneously switched to the locked state by requiring the entry operation. However, when the same automotive vehicle is used for a long time, the driver unconsciously performs the entry operation, so that the trouble mentioned above is repeated.

Then, the applicant or the assignee of the present invention suggests, in Japanese Patent Application Laid-Open No. 7-34742, a latch device in which an automotive door cannot be locked when it is in a door-open position. As shown in FIG. 10, this latch device is substantially constituted by the same construction as that of the conventional latch device mentioned above and further comprises a sub projection K formed at a lower end of the open link G and an immovable blocker L formed in the latch body. In this latch device, when the open link G is moved downward by the entry operation, the sub projection K becomes engageable with the blocker L before the main projection J is apart from the ratchet pin E. Accordingly, even when the entry operation is performed, the clockwise rotation of the lock lever H is precluded by an engagement between the sub projection K and the blocker L, so that the latch device cannot be switched to the locked state.

The latter latch device shown in FIG. 10 is structured simply but a cost for manufacturing the same is unexpectedly high. Because, in the latter device, switching the lock lever H to the locked position is precluded by utilizing two engagements such as the engagement between the main projection J and the ratchet pin E and the engagement between the sub projection K and the blocker L, so that a high accuracy is required for manufacturing the parts, particularly the open lever D and the open link G. Further, a high accuracy is required for mounting a rod used for connecting the open lever D to the open handle.

There is suggested another latch device, as shown in FIGS. 11 and 12, in which an automotive door cannot be locked when it is in a door-open position. This latch device comprises a latch B rotatably mounted to a latch shaft M and engageable with a striker A fixed to a vehicle body, a ratchet C rotatably mounted to a ratchet shaft N and engageable with the latch B, an open lever D connected to an open handle of the door, an open link G releasing the ratchet C from the latch B by engaging with the ratchet C when the open lever D is rotated, a lock lever H connected to a key cylinder and an inside lock button of the door and switched between an unlocked position for enabling an opening operation of the open link G and a locked position for disabling the opening operation of the open link G, a cam member P fixed to the latch B, and a block lever S rotatably mounted to a block shaft R.

In the another latch device, when the latch B is in the unlatched position, the block lever S is pushed by the cam member P, and a front end T of the block lever S is then moved into a space formed below a tip end U of the lock lever H as shown in dot line, thereby a locking rotation of the lock lever H in a clockwise direction in FIG. 12 is precluded.

As in the case of the another latch device, when the block lever S is used, a high accuracy with respect to the various kinds of parts is not required and a freedom in designing the latch device is increased. However, the another latch device has some disadvantages. A first problem is that the number of the parts is increased since the cam body P is used for transmitting the rotational movement of the latch B to the block lever S. A second problem is that a longitudinal length of the latch device is increased since the block lever S is disposed on an opposite side of the ratchet C on the basis of the latch B.

A third problem is that the block lever S can easily block the lock lever H supported by a shaft X perpendicular to the latch shaft M, but cannot easily block the lock lever supported by a shaft parallel to the latch shaft M. When the lock lever is supported by the shaft X perpendicular to the latch shaft M, the lock lever may be accessed by a gripping tool inserted into a gap between a window glass and the door frame with a high possibility, so that it is desirable that the lock lever is supported by the shaft parallel to the latch shaft M. A fourth problem is that three parts, i.e. the latch B, the cam member P and the block lever S are overlapped in the axial direction of the latch shaft M, as shown in FIG. 12. Due to this overlapping, a thickness, on a straight line connecting the latch shaft M and the ratchet shaft N, of the latch device becomes thick. Since the straight line substantially coincides with a moving locus of the window glass of the door, the thickness of the latch device gives a bad influence to a design of the window glass.

SUMMARY OF THE INVENTION

Accordingly, an object of the present invention is to provide an automotive door latch device which overcomes deficiencies in the prior art such as noted above.

Further, another object of the present invention is to provide a door latch device in which a ratchet and a block lever are arranged substantially in a lateral direction, thereby reducing a vertical length without substantially increasing a lateral length.

Still further, another object of the present invention is to provide a door latch device in which a block lever is connected to a ratchet by a connecting pin, thereby omitting a cam member.

Furthermore, another object of the present invention is to provide a door latch device in which a latch and a ratchet are arranged on a front side of a latch body, and a block lever and a lock lever are arranged on a rear side of the latch body, thereby easily achieving a connection between the block lever and the lock lever.

Moreover, another object of the present invention is to provide a door latch device in which a lock lever is supported to a ratchet shaft parallel to a latch shaft, thereby increasing an anti-theft performance of the lock lever.

Further, another object of the present invention is to provide a door latch device in which a block lever is provided with a connection arm which extends substantially to a horizontal direction from the block shaft toward the ratchet shaft and is connected to the ratchet by the connection pin, and a hook arm which is substantially formed in an L-shape and engageable with the lock lever, thereby easily obtaining a rotation amount of the block lever sufficient to switch between a blocking position and an unblocking position.

BRIEF DESCRIPTION THE DRAWINGS

DESCRIPTION OF THE PREFERRED EMBODIMENTS

Figure 1:
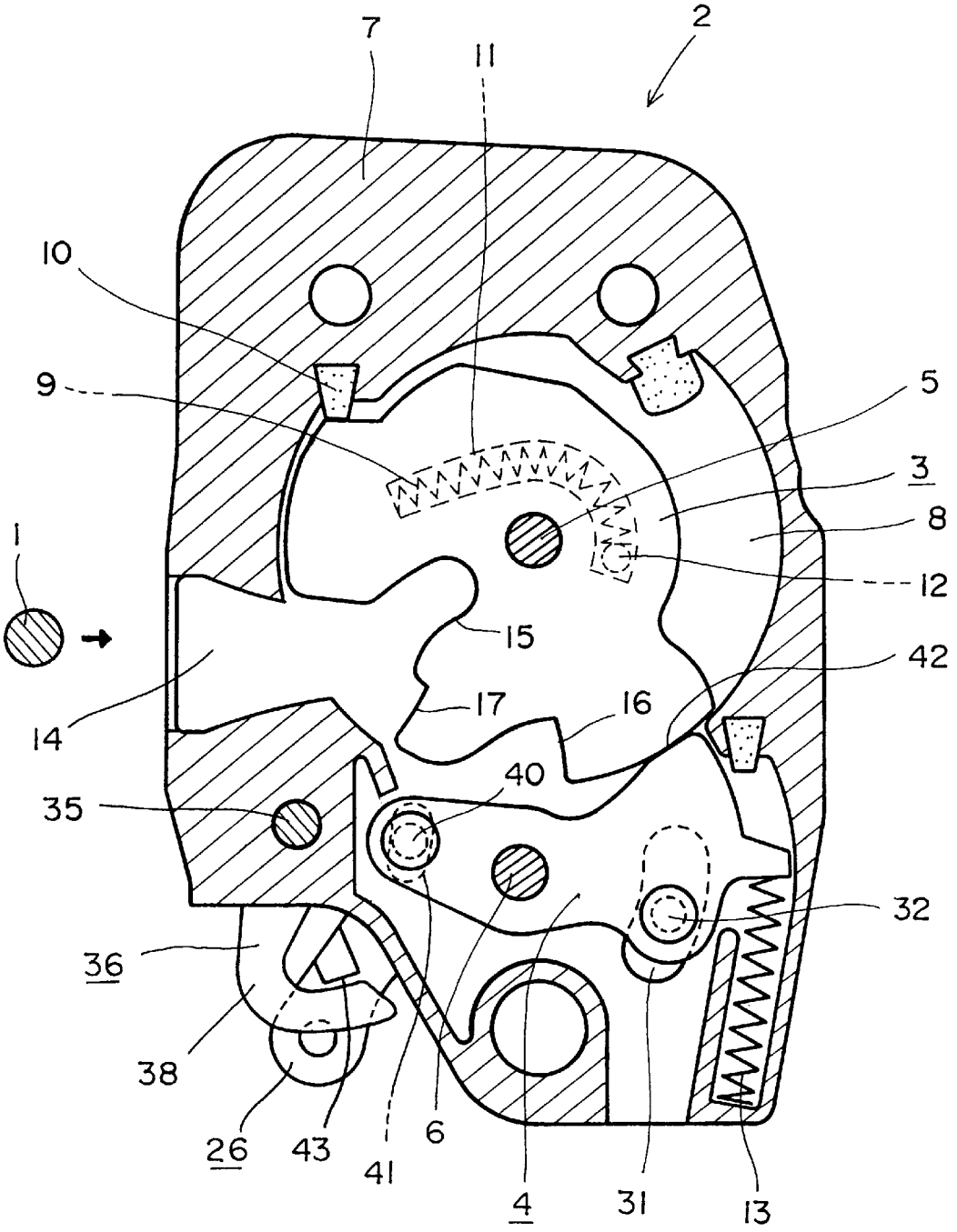
FIG. 1 is a vertically sectional front view of a latch device in accordance with the present invention in a door-open state.

An embodiment of the present invention will now be described below with reference to the drawings. An automotive door latch device in accordance with the present invention is constituted by a striker 1 fixed to a vehicle body (not shown) and a latch assembly 2 fixed to a door (not shown). The latch assembly 2 has a latch 3 adapted to be engaged with the striker 1 when the door is closed and a ratchet 4 for keeping the engagement between the latch 3 and the striker 1. The latch 3 and the ratchet 4 are rotatably received within a recess 8 formed on a front surface of a latch body 7 made of a synthetic resin by means of a latch shaft 5 and a ratchet shaft 6, respectively.

Figure 2:
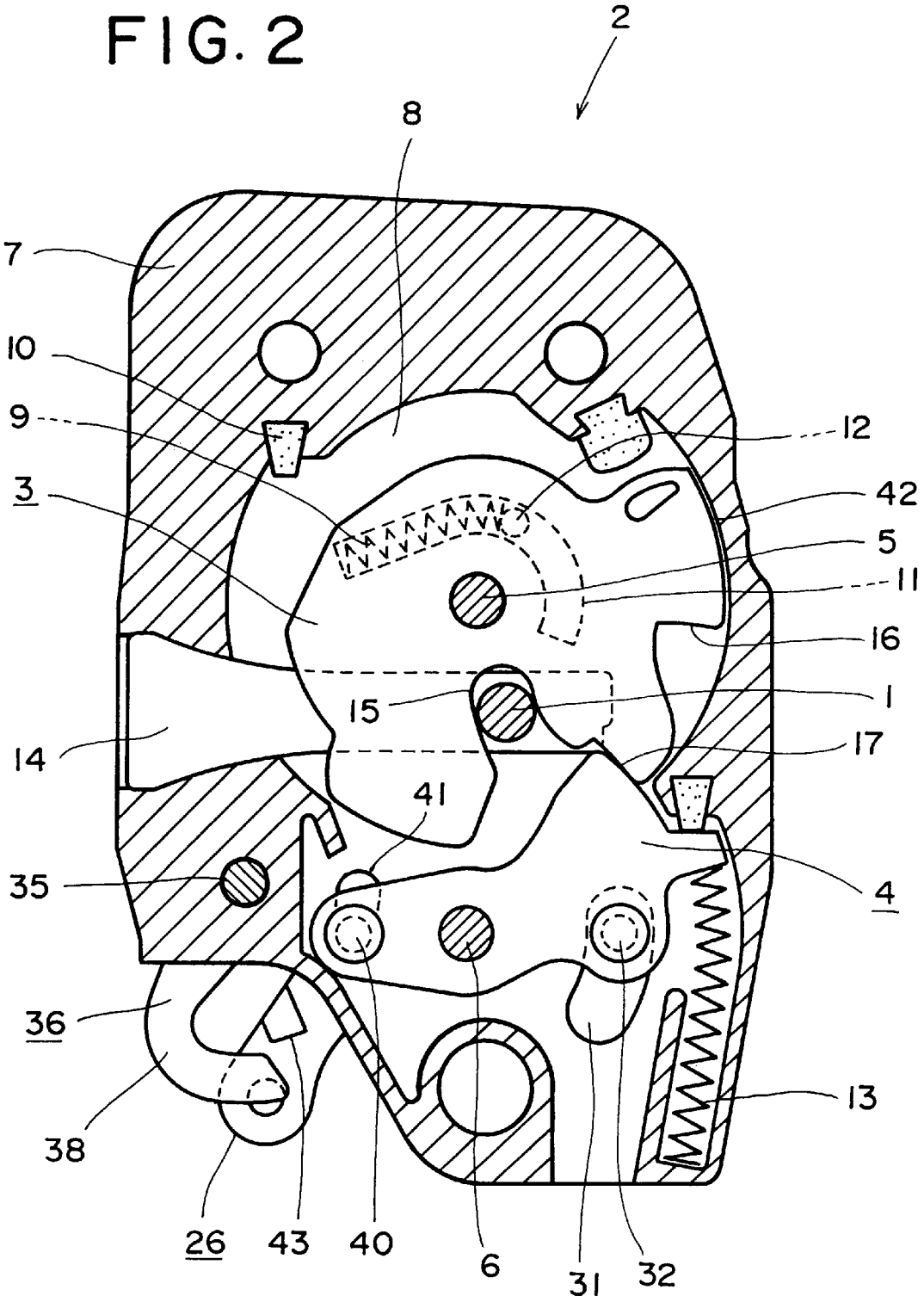
FIG. 2 is a vertically sectional front view of the latch device in door closed state.

The latch 3 is urged clockwise in FIG. 1 by means of the resilient force of a spring 9, and is brought into contact with a damping member 10 fixed to the latch body 7 when the door is in an open position (an unlatched position). The spring 9 is housed within a groove 11 formed in the latch body 7, and presses a projection 12 of the latch 3. The ratchet 4 is urged counterclockwise in FIG. 1 by means of the resilient force of a spring 13, and is brought into contact with the latch 3. When the door moves toward a closed position from the open position, the striker 1 enters into a horizontal passage 14 formed in the latch body 7, and then comes into contact with a U-shaped groove 15 of the latch 3, thereby the latch 3 is rotated counterclockwise against the resilient force of the spring 9. When the latch 3 is turned from an unlatched position shown in FIG. 1 to a half-latched position, the ratchet 4 is engaged with a first step 16 of the latch 3 by the resilient force of the spring 13, and when the latch 3 comes to a full-latched position shown in FIG. 2, the ratchet 4 is engaged with a second step 17 of the latch 3, thereby the door is kept in the closed position. The latch 3 and the ratchet 4 are arranged on the same plane, and a straight line connecting between the latch shaft 5 and the ratchet shaft 6 is arranged in such a manner as to cross the horizontal passage 14 substantially in a perpendicular direction.

Figure 4:
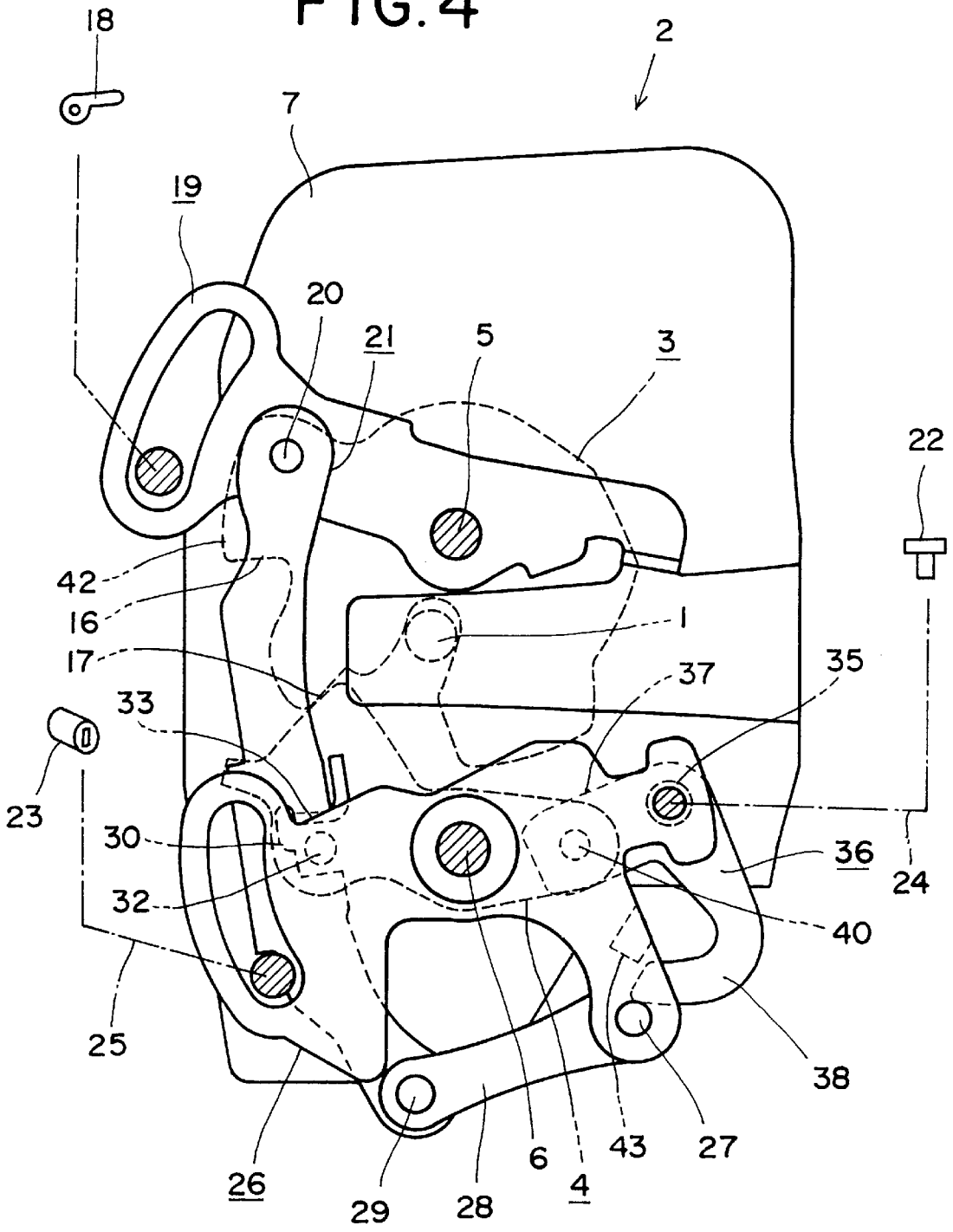
FIG. 4 is a rear elevational view of the latch device in the door-closed and an unlocked states.
Figure 5:
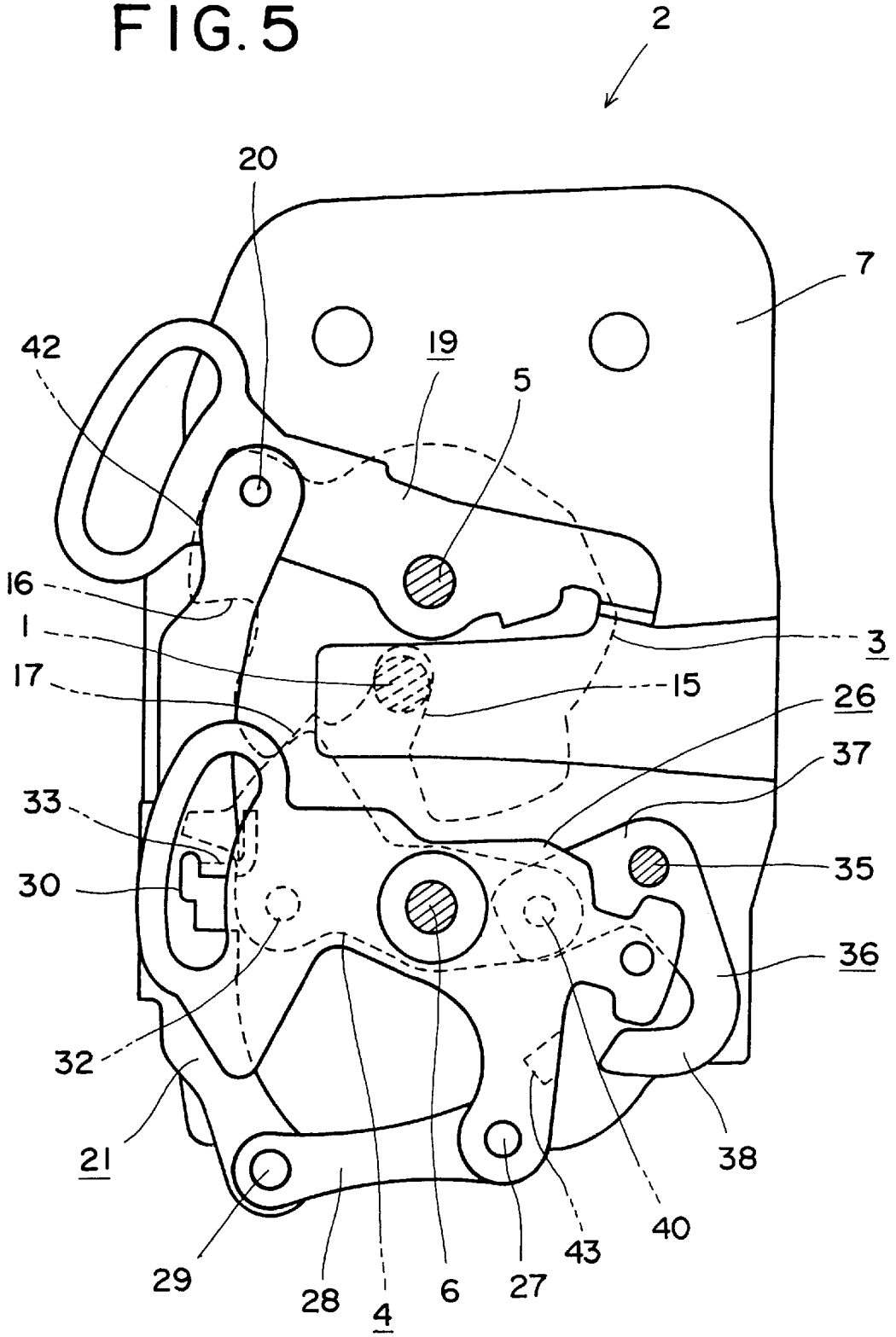
FIG. 5 is a rear elevational view of the latch device in the door-closed and a locked states.
Figure 6:
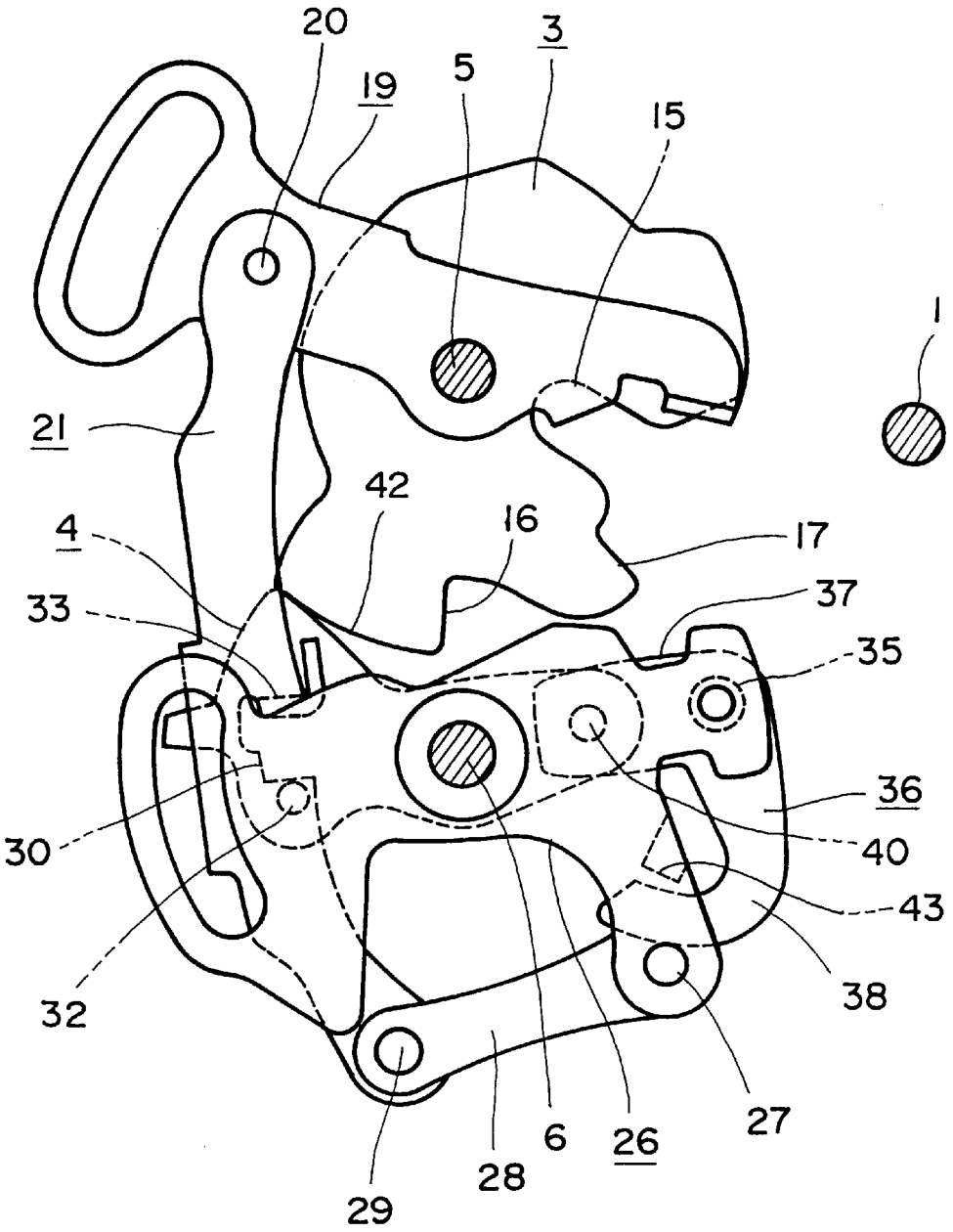
FIG. 6 is a rear elevational view of the latch device in the door-open and the unlocked state.
Figure 7:
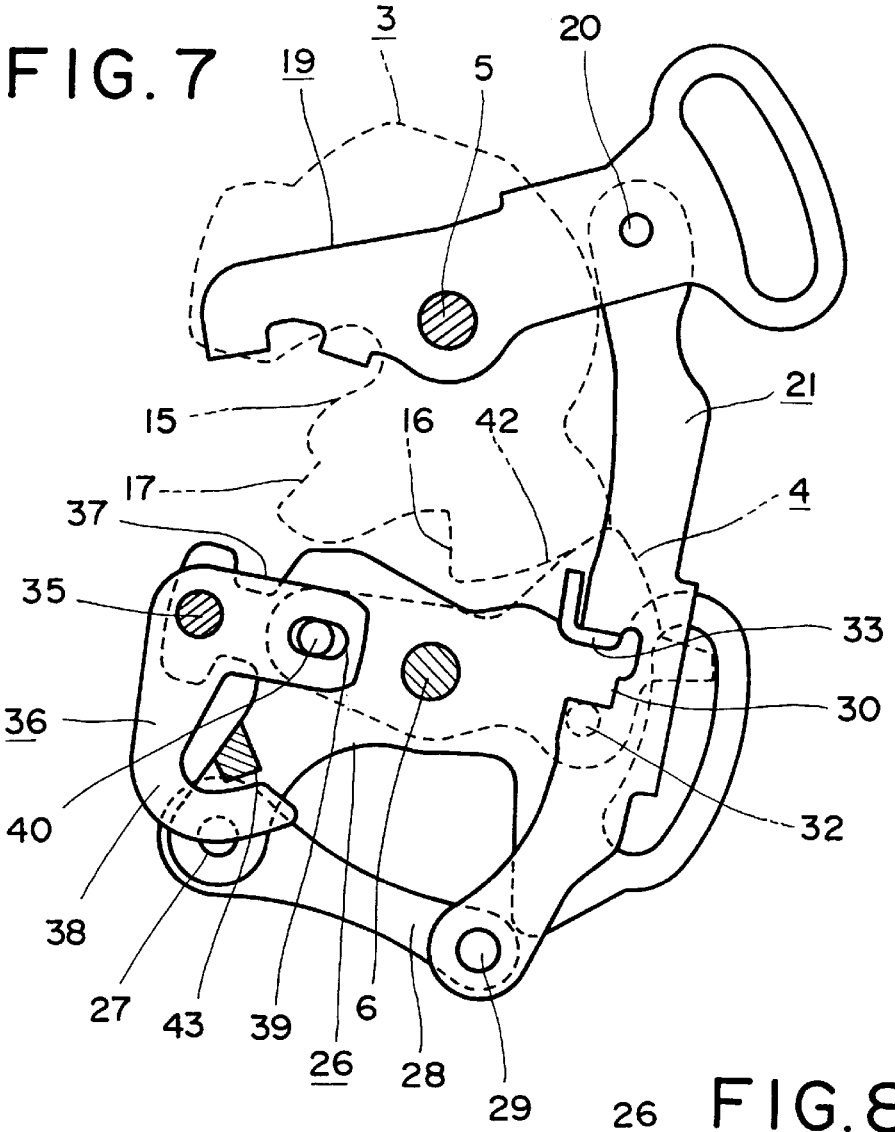
FIG. 7 is a schematic view of the latch device shown in FIG. 6 as seen from a front side.
Figure 8:
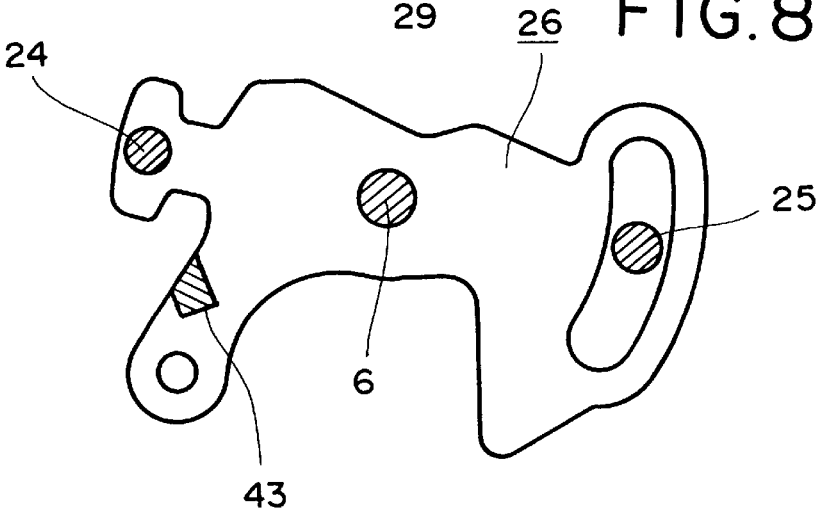
FIG. 8 is a front elevational view of a lock lever of the latch device.
Figure 9:
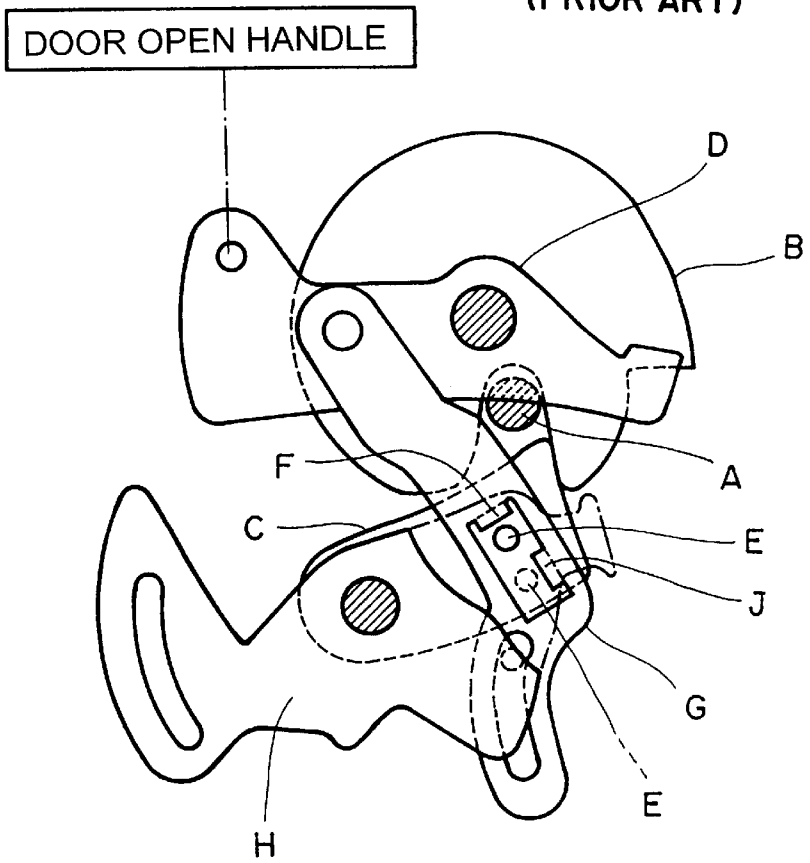
FIG. 9 (PRIOR ART)
FIGS. 9 to 12 are schematic views which show a conventional latch devices.
Figure 10:
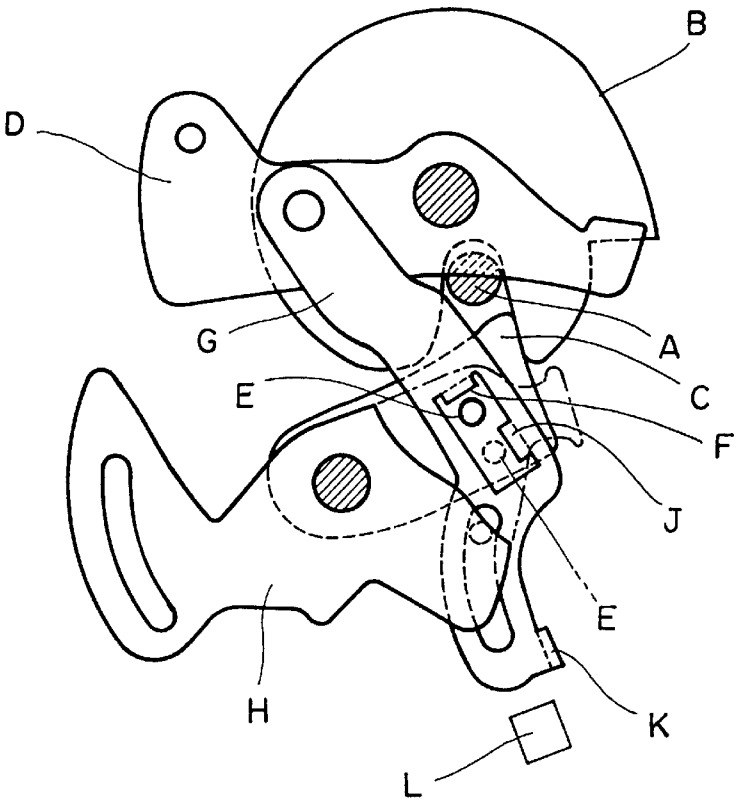
FIG. 10 (PRIOR ART)

As shown in FIGS. 4 to 6, in a rear side of the latch body 7, an open lever 19 which is connected to a door open handle 18 of the door is rotatably supported to the latch shaft 5. An open link 21 is connected to the open lever 19 by a pin 20. Further, in the rear side of the latch body 7, a lock lever 26 which is connected to an inside lock button 22 and a key cylinder 23 of the door through rods 24 and 25, is rotatably supported to the ratchet shaft 6. One end of an intermediate link 28 is connected to the lock lever 26 by a pin 27, and the other end of the intermediate link 28 is connected to a lower end of the open link 21 by a pin 29. The lock lever 26 is displaced between an unlocked position shown in FIG. 4 and a locked position shown in FIG. 5 by an operation of the inside lock button 22 and the like. A notch portion 30 is formed in a middle portion of the open link 21. At an edge portion of the notch portion 30 is formed a bent portion 33 which is engageable with a ratchet pin 32 projecting to the rear side of the latch body 7 from the ratchet 4 through a hole 31 of the body 7.

FIGS. 4 and 5 show a full-latched or door-closed state of the latch device in which the ratchet 4 is engaged with the second step 17 of the latch 3. As shown in FIG. 4 the bent portion 33 of the open link 21 is opposed to the ratchet pin 32 when the lock lever 26 is in the unlocked position under the full-latched state. Thus, when the open link 21 is caused to be moved downward by rotating the open lever 19 by means of the open handle 18, the bent portion 33 is brought into contact with the ratchet pin 32 to rotate the ratchet 4 against the resilient force of the spring 13, thereby the ratchet 4 is disengaged from the second step 17 of the latch 3 and the latch 3 is returned to the unlatched position as shown in FIG. 6 so as to open the door.

As shown in FIG. 5, the open link 21 is substantially shifted to a leftward direction when the lock lever 26 is in the locked position under the full-latched state, thereby the bent portion 33 becomes disengageable with the ratchet pin 32. Accordingly, the downward movement of the open link 21 cannot rotate the ratchet 4, so that the door cannot be opened.

Figure 3:
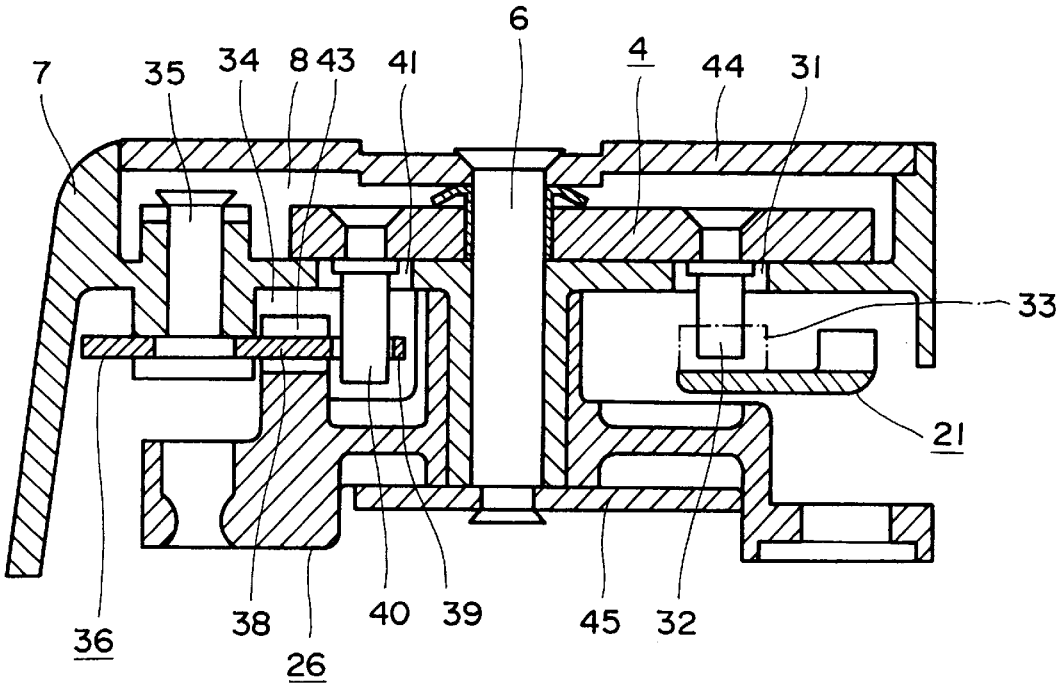
FIG. 3 is a horizontally sectional plan view of the latch device.

As shown in FIG. 3, between the lock lever 26 and the rear surface of the latch body 7, is provided a relatively narrow space 34 in which a block lever 36 is accommodated. The block lever 36 is rotatably mounted on the latch body 7 by means of a block shaft 35. A straight line connecting the block shaft 35 and the ratchet shaft 6 is arranged in such a manner as to be substantially in parallel to the horizontal passage 14. The block lever 36 has a connection arm 37 which extends toward the ratchet shaft 6 from the block shaft 35, and a hook arm 38 substantially formed in an L-shape. An oblong hole 39 is provided at a tip end of the connection arm 37. A connection pin 40 of the ratchet 4 projects to the rear side of the body 7 through an opening portion 41 formed in the body 7, and is slidably engaged with the oblong hole 39. The block lever 36 is interlocked with the ratchet 4 by the engagement between the connection pin 40 and the oblong hole 39 and displaced between a blocking position (FIG. 6) and an unblocking position (FIGS. 4 and 5) according to the movement of the ratchet 4.

The block lever 36 is in the unblocking position shown in FIG. 4 under the full-latched state (or the half-latched state) in which the ratchet 4 is engaged with the second step 17 (or the first step 16) of the latch 3. At the unblocking position, the hook arm 38 of the block lever 36 is disengageable with the lock lever 26. Accordingly, the lock lever 26 can be rotated clockwise in FIG. 4 by the locking operation of the inside lock button 22 to move the open link 21 leftward as shown in FIG. 5 so as to change the latch device into the locked state in which the bent portion 33 is apart from the ratchet pin 32.

On the contrary, when the latch 3 is displaced into the unlatched position as shown in FIG. 6, the connection pin 40 is slightly moved upward from the position shown in FIG. 4 due to the engagement between the latch 4 and a large diameter surface 42 of the latch 3, and the block lever 36 is then rotated clockwise direction around the block shaft 35 and is displaced into the blocking position. In this state, the hook arm 38 is engageably opposed to an engagement surface 43 formed on the lower surface of the lock lever 26 to preclude the lock lever 26 from being rotated clockwise toward the locked position. Accordingly, when the door is in the open state, it becomes impossible to switch the lock lever 26 into the locked position. When closing the door, the block lever 36 is shifted to the unblocking position, the hook arm 38 is apart from the engagement surface 43, thereby enabling the clockwise rotation of the lock lever 26 toward the lock position.

In FIG. 3, a metal cover plate 44 for substantially covering the recess 8 of the latch body 7 is mounted to the front side of the latch body 7, and a metal back plate 45 is mounted to the rear side of the latch body 7.

ADVANTAGES

In the latch device in accordance with the present invention, when the latch 3 is in the unlatched position, the block lever 36 is engageably opposed to the lock lever 26 in order to preclude the lock lever 26 from being displaced toward the locked position, so that the trouble of closing the door under the locked state while putting the door key within the vehicle cabin can be prevented.

Further, since the ratchet 4 and the block lever 36 are arranged in parallel to each other substantially in the lateral direction, the longitudinal length of the latch device can be reduced without substantially increasing the lateral length of the latch device, and further, it is prevented to substantially increase the thickness of the latch device on the straight line connecting between the latch shaft 5 and the ratchet shaft 6.

Figure 11:
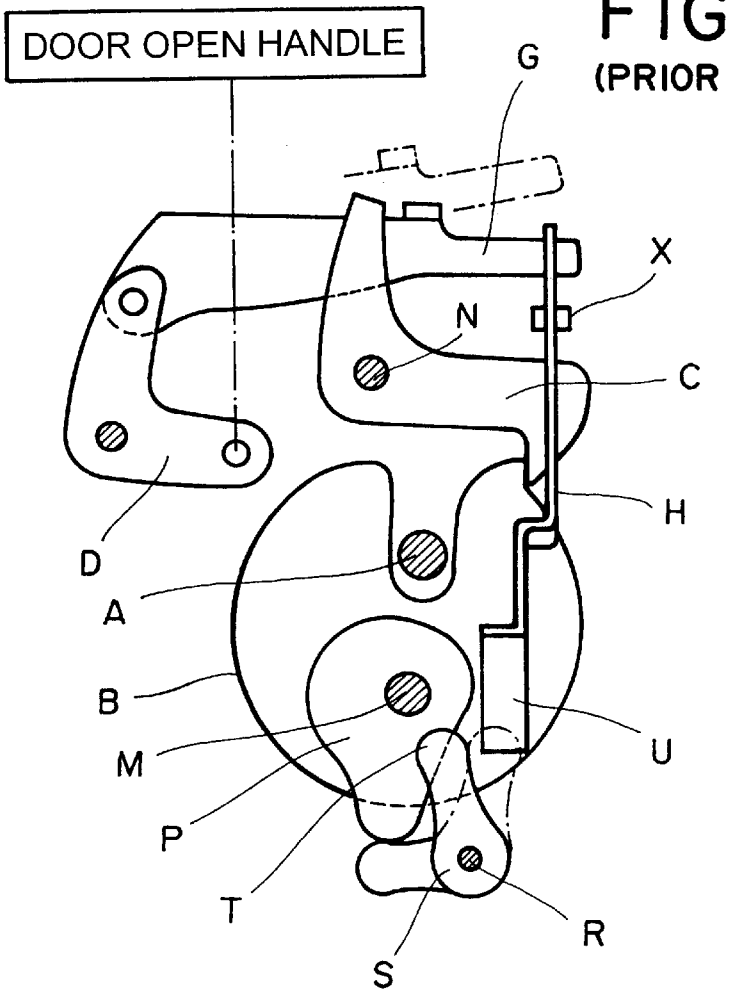
FIG. 11 (PRIOR ART)
Figure 12:
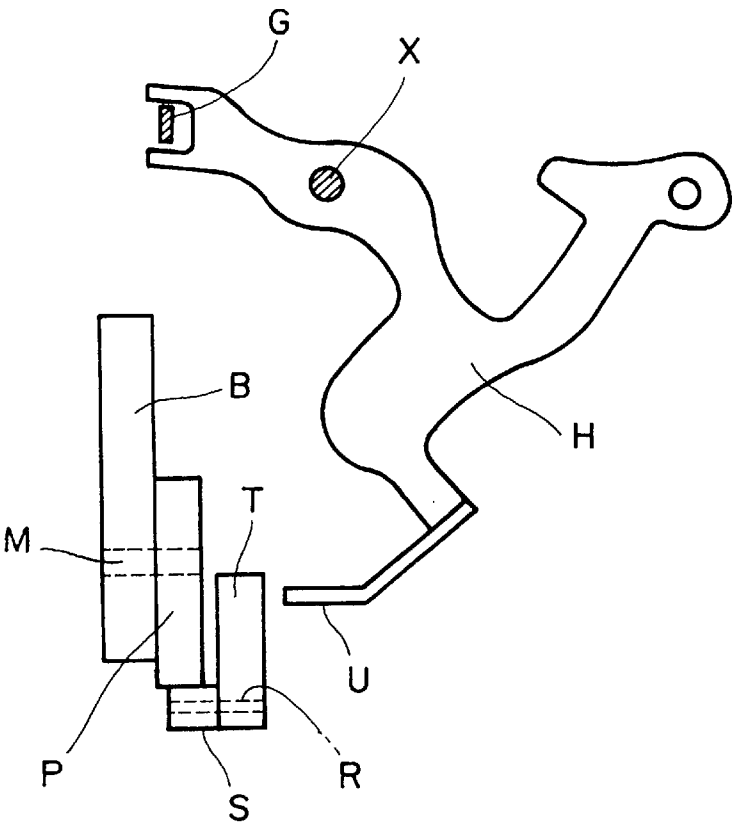
FIG. 12 (PRIOR ART)

Still further, since the block lever 36 is connected to the ratchet 4 by the connection pin 40, the cam body which is used in the conventional latch device shown in FIGS. 11 and 12 can be omitted.

Furthermore, since the latch 3 and the ratchet 4 are arranged in the front side of the latch body 7 and the block lever 36 and the lock lever 26 are arranged in the rear side of the latch body 7, the connection between the block lever 36 and the lock lever 26 can be easily achieved.

Moreover, since the lock lever 26 is rotatably supported to the ratchet shaft 6, the lock lever which is excellent in an anti-theft performance can be used.

Further, since the block lever 36 has the connection arm 37 which extends substantially in the horizontal direction from the block shaft 35 toward the ratchet shaft 6 and is connected to the ratchet 4 through the connection pin 40 and the substantially L-shaped hook arm 38 which is engageable with the lock lever 26, a rotation amount of the block lever sufficient to switch between a blocking position and an unblocking position can be easily obtained.

What is claimed is:

1. An automotive door latch device comprising:

a latch body adapted to be fixed to an automotive door;

a horizontal passage formed in the latch body and receiving a striker fixed to a vehicle body when the door moves toward a door-closed position from a door-open position;

a latch rotatably mounted to the latch body by means of a latch shaft and displaceable from an unlatched position to a full-latched position by engaging with the striker when the door moves toward the door-closed position;

a ratchet rotatably mounted to the latch body by means of a ratchet shaft parallel to the latch shaft and engageable with the latch for holding an engagement between the latch and the striker;

said latch and said ratchet being substantially arranged along a vertical direction;

an opening mechanism connected to an open handle of the door and releasing the ratchet from the latch for opening the door when the open handle is operated;

a lock lever connected to a key cylinder and an inside lock button of the door and switched between an unlocked position for enabling an opening operation of the opening mechanism and a locked position for disabling the opening operation of the opening mechanism; and a block lever rotatably mounted to the latch body by means of a block shaft and engaging with the lock lever when the latch is in the unlatched position so as to prevent the lock lever from moving from the unlocked position to the locked position;

wherein a straight line connecting the ratchet shaft and the block shaft is substantially in parallel to the horizontal passage of the latch body.

2. An automotive door latch device according to claim 1, wherein said block lever is connected to the ratchet lever by means of a connection pin.

3. An automotive door latch device according to claim 2, wherein said block lever comprises a connection arm which extends substantially to a horizontal direction from the block shaft toward the ratchet shaft and is connected to the ratchet by the connection pin, and a hook arm which is substantially formed in an L-shape and engageable with the lock lever.

4. An automotive door latch device according to claim 1, wherein said latch and said ratchet are arranged in a front side of the latch body, and said block lever and said lock lever are arranged in a rear side of the latch body.

5. An automotive door latch device according to claim 4, wherein said lock lever is rotatably supported to the ratchet shaft.

6. An automotive door latch device according to claim 4, wherein a space for housing said block lever is provided between the lock le ver and a rear surface of the latch body.

* * * * *